US005569129A

United States Patent [19]

Seif-Naraghi et al.

[11] Patent Number: 5,569,129

[45] Date of Patent: Oct. 29, 1996

[54] DEVICE FOR PATIENT GAIT TRAINING

[75] Inventors: Amir Seif-Naraghi, Scottsdale; David L. Dilli; Stephen C. D'Luzansky, both of Phoenix; Richard M. Herman, Scottsdale, all of Ariz.

[73] Assignee: Mobility Research L.L.C., Tempe, Ariz.

[21] Appl. No.: 258,346

[22] Filed: Jun. 10, 1994

[51] Int. Cl.[6] ..... A61H 3/04

[52] U.S. Cl. ..... 482/69; 602/36; 135/67

[58] Field of Search ..... 482/23, 43, 69; 602/32–36; 606/241; 5/81.1, 83.1, 84.1, 85.1; 297/275, DIG. 10; 135/67

[56] References Cited

U.S. PATENT DOCUMENTS

| | | | |
|---|---|---|---|
| 2,625,202 | 1/1953 | Richardson et al. | 482/69 |
| 2,719,568 | 10/1955 | Webb | 482/69 |
| 3,252,704 | 5/1966 | Wilson | 482/69 |
| 3,711,877 | 1/1973 | Averill | 5/81.1 |
| 3,761,082 | 9/1973 | Barthel, Jr. | 482/69 |
| 4,655,447 | 4/1987 | Dubrinsky et al. . | |
| 4,761,842 | 8/1988 | Weiner | 5/81.1 |
| 4,898,378 | 2/1990 | Edwards . | |
| 5,029,801 | 7/1991 | Dalebout et al. . | |
| 5,031,898 | 7/1991 | Anthony | 482/70 |
| 5,100,127 | 3/1992 | Melnick et al. . | |
| 5,162,029 | 11/1992 | Gerard . | |
| 5,205,800 | 4/1993 | Grant . | |
| 5,273,502 | 12/1993 | Kelsey et al. | 482/69 |
| 5,309,584 | 5/1994 | Parker | 5/81.1 |
| 5,333,333 | 8/1994 | Mah | 5/81.1 |
| 5,502,851 | 4/1996 | Costello | 486/69 |

*Primary Examiner*—Richard J. Apley
*Assistant Examiner*—Jeanne M. Clark
*Attorney, Agent, or Firm*—Harry M. Weiss; Jeffrey D. Moy; Harry M. Weiss & Associates, P.C.

[57] ABSTRACT

A small, transportable, and rollable device for lifting and supporting patients undergoing partial weight bearing gait training (over treadmill or over ground) is provided. The carriage underlying this device is "U"-shaped with a pair of low horizontal rails making up the arms of the "U" and the lifting equipment being mounted at the closed end of the "U". Low profile for movement through doors and in low-ceiling rooms is achieved by a vertically telescoping height adjustment to the top of which is connected a horizontal "Y"-shaped connection to provide two connection points at the ends of the "Y" (and above and between the rails) for a patient harness. The harness construction provides sufficient adjustability for a therapist to achieve equal division of support among groin, abdominal, and chest areas, while permitting full leg extension of the patient. The low rails enable unobstructed access to the patient's legs during gait training.

13 Claims, 3 Drawing Sheets

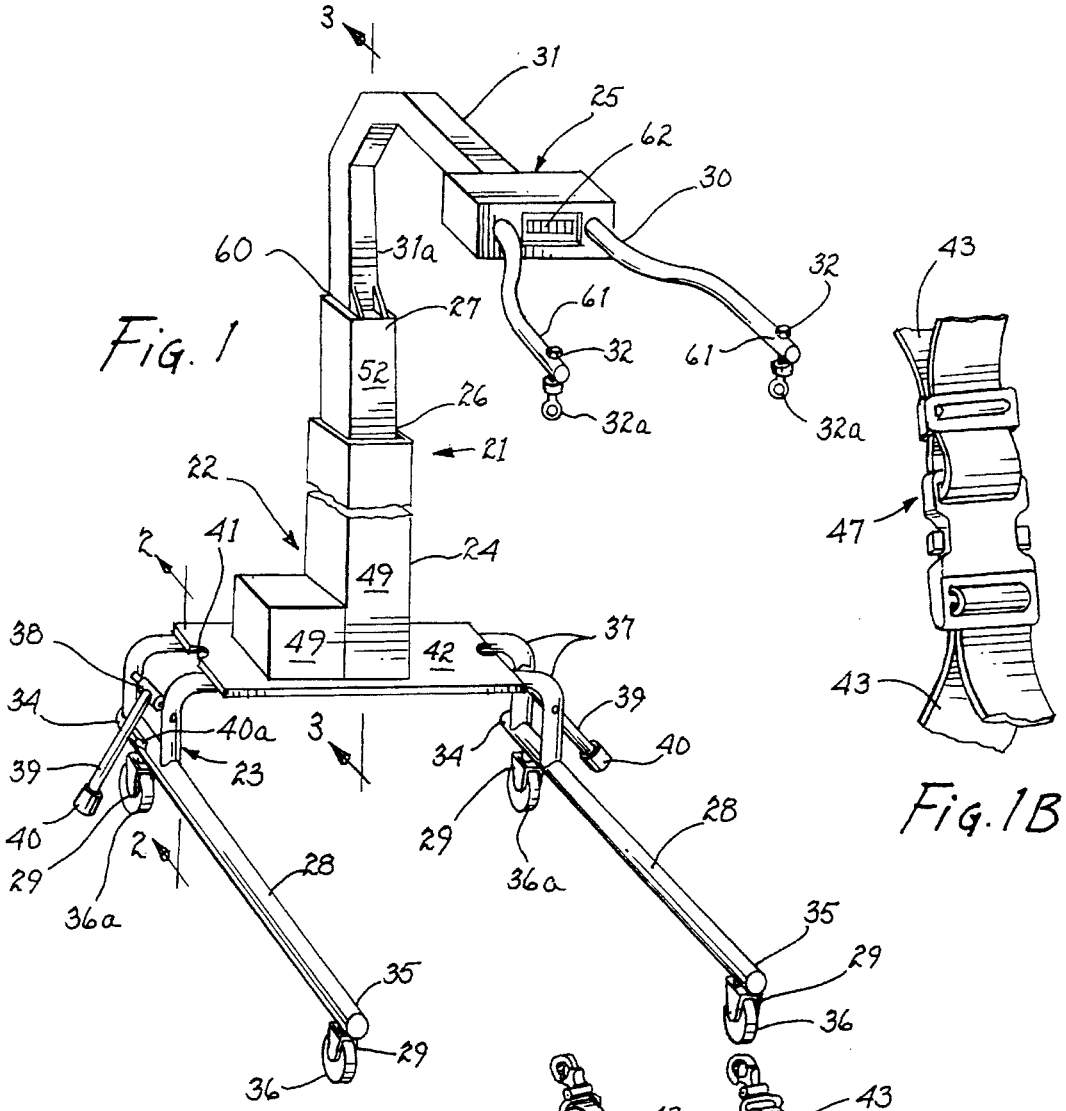
FIG. 1
FIG. 1B
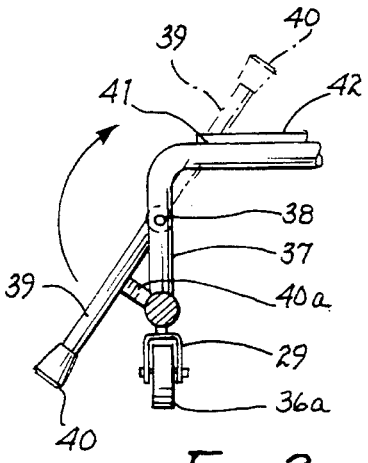
FIG. 2
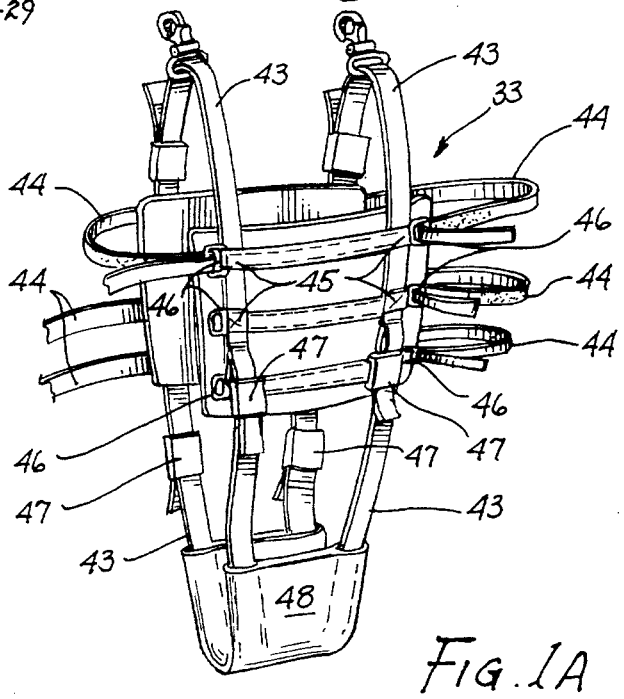
FIG. 1A

DEVICE FOR PATIENT GAIT TRAINING

BACKGROUND OF THE INVENTION

1. Field of the Invention

This invention relates generally to a device for patient gait training wherein the device provides partial weight bearing of the walking-impaired patient during such gait training. More specifically, this invention provides, in one unitary device, efficiently combined for use by a therapist, a device for partial weight bearing (PWB) gait training of a patient assisting many useful elements and functions, e.g., use to support a patient over a treadmill; use with both pediatric and adult patients; use with a patient over ground; use in assisting wheelchair patients from a seated position to a standing position; provision of a proper upright posture and leg extension; use with walkers and other attachments; ability to easily move the device through doors and the ability to use the device in low-ceiling rooms; provision of a fully vertical lift for PWB; and provision of constant easy access for the therapist to the legs of the patient during training.

2. Description of the Prior Art

To those skilled in the art, terms such as "gait training"and "partial weight bearing" are well known. In general, the former term refers to a method of training a person to walk, and the later term is one particular example of gait training. Partial weight bearing or partial weight bearing gait training is a method of training a patient to walk wherein the weight of the patient is partially supported by some device, and the amount of weight relief provided by the device for the patient is gradually reduced as the patient learns to walk normally. In other words, the person becomes physically capable of supporting his or her own full weight while walking.

For many years, institutions such as hospitals, nursing homes, physical therapy clinics, psychiatrists in private practice, school systems, outpatient centers, and rehabilitation facilities have had the need to provide both inpatient and outpatient physical therapy services for patients with walking disorders who require retraining, including partial weight relief of the patient during such training. Typically, the amount of weight relief provided a patient undergoing gait training is less and less as the course of the gait training progresses.

Typically, at present, large institutions like hospitals may provide a separate room location containing a ceiling track or frame structure from which may be suspended a cable hoist. The patient is placed in a harness attached to the cable, the weight of the patient is relieved by raising the cable, and the patient may then use a treadmill or may be supported for floor movement by moving the cable device along the ceiling track.

Also typically, pools providing underwater buoyancy have been used for weight relief. Obviously, such devices are very expensive, are not transportable to alternative locations, and are often inefficient both in controlling the amount of weight relief and in providing proper posture support.

More recently, typically for treadmill use in smaller institutions, a smaller device has been available which consists of a pair of heavy side elements/standards with triangular bases across the tops of which lies a crossbar element from which a cable and harness are suspended. Some prior art gait training devices lift a patient in a manner that alters a patient's posture from the normal desired walking posture—a substantially straight standing posture of the body. For example, the movement of the lifting portion of some prior art gait training devices forms an arc when the lifting portion is viewed as moving from a lowest to a highest position. This arc motion, as opposed to a linear, vertical motion, distorts the normal walking posture of a patient, and is therefore undesirable. Additionally, such prior art devices do not fit through normal doors, are not movable when the patient walks, do not permit the therapist unobstructed access to the patient's legs, and are otherwise inefficient for PWB gait training of patients with moderate to severe gait deficits.

Thus, for a considerable time period there has existed a need, to which the present invention is addressed, for a unitary device for use in partial weight bearing training of a patient, which addresses the above-mentioned and other problems in an efficient, cost-effective, combinatorial, creative, and operational manner. Nowhere, until the present invention, has there been provided an efficient and easily transportable PWB gait training device which may be used either with a treadmill or with a patient moving over ground while simultaneously permitting variable, linear, vertical lifting of a patient, thereby maintaining proper patient walking posture.

OBJECTS OF THE INVENTION

Accordingly, it is an object of this invention to provide an improved device for partial weight bearing (PWB) gait training of a patient.

It is a further object of this invention to provide, in a unitary device, in creative combination, multiple elements and functions which together overcome the problems presented by the prior art.

It is a further object of this invention to provide a safe and efficient and easily transportable PWB gait training device which may be used either with a treadmill or with a patient moving over ground.

Another object of this invention is to provide an improved device useful with both pediatric and adult patients. Yet another object is to provide an improved device useful in assisting wheelchair patients and others impaired into a gait training position. Still another object is to provide an improved device useful in providing a proper upright posture and leg extension to patients during gait training. Also, it is an object of this invention to provide an improved device useful in gait training with walkers and other attachments. Still another object is the provision of a device for partial weight bearing (PWB) training of a patient wherein the device is able to be moved easily through normal doors and used in low-ceiling rooms. An additional object of this invention is to provide a fully vertical lift for PWB. Yet an additional object is to provide an improved device for PWB gait training of a patient by a therapist which provides constant easy access for the therapist to the legs of the patient during training.

SUMMARY OF THE INVENTION

According to the foregoing objectives, this invention describes an improved device for PWB gait training of a patient which device is unitary in construction and yet provides, in combination, elements and functions fulfilling all of said objectives.

Further, this invention provides, in a unitary device for use in partial weight bearing gait training of a patient, harness means for holding said patient in an upright position; support means for controlled vertical support of such harness means; and, underlying such support means, carriage means for controlled horizontal movement of such unitary device by a therapist. The instant invention further provides such a unitary device wherein such support means and such carriage means are constructed and arranged for permitting a therapist unobstructed access to both legs of a patient being supported by such unitary device. And such unitary device is further provided wherein such carriage means comprises a pair of horizontal parallel rail means unconnected at a first end of such pair of rail means. And such unitary device is further provided wherein such support means is mounted adjacent a second end of such pair of rail means. Further, such unitary device is provided wherein such harness means is normally located above such first end of such pair of rail means. And such unitary device is provided wherein wheel means are connected to such pair of rail means. Also, such unitary device is provided wherein such device is constructed and arranged for permitting a therapist to control incremental horizontal movement of such device. Further, such unitary device is provided wherein such device includes motor means for implementing controlled incremental vertical movement of a harness supporting a patient. Additionally, if desired, motor means may be integrated to the device in order to provide force for moving the device over the ground.

The instant invention further provides such a unitary device for use in partial weight bearing gait training of a patient wherein such support means comprises harness connection means; and vertical adjustment means, including an upper portion of such vertical adjustment means, for controlling the height of such harness connection means. Also, this invention provides such a unitary device wherein such harness connection means comprises a horizontally-disposed "Y"-shaped connection means including a foot end and a pair of arm ends; wherein such foot end of said "Y"-shaped connection means is attached to such upper portion of such vertical adjustment means and is vertically movable by such upper portion of such vertical adjustment means; and wherein such arm ends of such "Y"-shaped connection means are constructed and arranged for connection to such harness means. Further, this invention provides such a unitary device wherein such arm ends of such "Y"-shaped connection means include means, such as a strain gage means or dial indicator means, for providing an indication of the amount of patient weight being supported by the device. Still further, this invention provides such a unitary device wherein such arm ends of such "Y"-shaped connection means include fastening means for removably attaching such harness means to such arm ends of such "Y"-shaped connection means.

The instant invention further provides such a unitary device wherein such vertical adjustment means comprises telescoping means for controlling the height of such upper portion of such vertical adjustment means. Such unitary device of this invention may further include battery means for controlling an electric motor for controlling the height of such upper portion of such vertical adjustment means. Moreover, a battery charger may be included for recharging the battery means. There is further provided such a unitary device wherein such harness connection means is rotatable about such vertical adjustment means.

And such unitary device is further provided wherein such harness means is constructed and arranged to support the partial body weight of a patient evenly among groin, abdominal, and chest areas. The instant invention provides a harness device for holding a patient in an upright position for use in partial weight bearing gait training of such patient, comprising harness means including a pair of vertically-disposed harness loop means; and multiple horizontally-disposed harness belt means attached to such harness loop means, each such harness belt means being adjustable to support a selected torso portion of such patient; wherein such harness means is constructed and arranged to support the partial body weight of a such patient evenly among groin, abdominal, and chest areas. Such harness device of the present invention may include groin pad means, wherein the bottom portions of such harness loop means are attached to such groin pad means, such groin pad means comprising a soft, slippery material.

Also, this invention provides, in a unitary device for use in partial weight bearing gait training of a patient, harness means for holding a such patient in an upright position; support means for controlled vertical support of such harness means; wherein such support means comprises harness connection means and vertical adjustment means, including an upper portion of such vertical adjustment means, for controlling the height of such harness connection means. And this invention provides such a unitary device wherein such harness connection means comprises a horizontally-disposed "Y"-shaped connection means including a foot end and a pair of arm ends; wherein such foot end of such "Y"-shaped connection means is attached to such upper portion of such vertical adjustment means and is vertically movable by such upper portion of such vertical adjustment means; and wherein such arm ends of said "Y"-shaped connection means are constructed and arranged for connection to such harness means.

BRIEF DESCRIPTION OF THE DRAWINGS

FIG. 1 is a pictorial illustration of a preferred embodiment of the unitary device for patient gait training of the present invention, further illustrating such device ready to have the harness means of the present invention attached thereto.

FIG. 1A is a pictorial illustration of a preferred embodiment of the harness means of the present invention, shown ready for attachment to the device as shown in FIG. 1.

FIG. 1B is a pictorial illustration of a safety buckle of the harness means of the present invention.

FIG. 2 is a partial front view, partially in section, along the section 2—2 of FIG. 1, showing the stabilizing appendage of the present invention in its position of use, and showing its stowed position in dotted lines.

DETAILED DESCRIPTION

Figure 3:
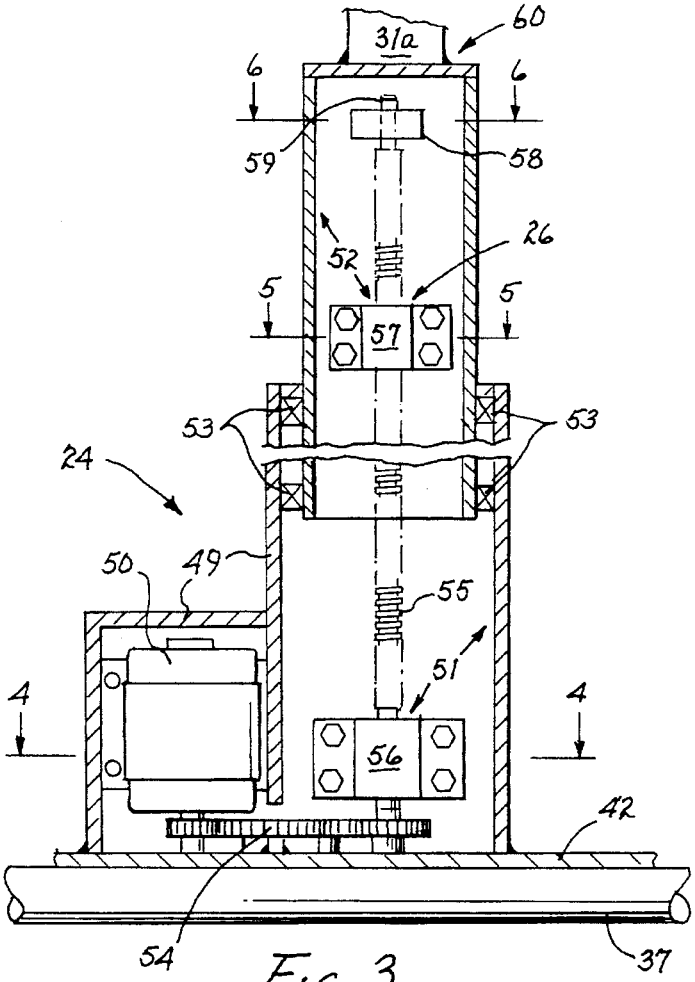
FIG. 3 is a partial front view, partially in section, along the section 3—3 of FIG. 1, of the vertical adjustment means of a preferred embodiment of the unitary device for patient gait training of the present invention and showing the telescoping means of the present invention.
Figure 5:
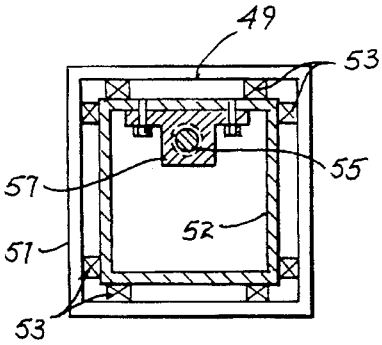
FIG. 5 is a top view, partially in section, along the section 5—5 of FIG. 3, of a central portion of the telescoping means of the vertical adjustment means of a preferred embodiment of the present invention.
Figure 6:
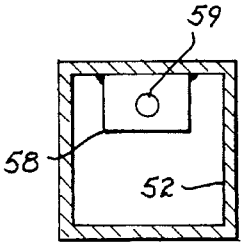
FIG. 6 is a top view, partially in section, along the section 6—6 of FIG. 3, of an upper portion of the telescoping means of the vertical adjustment means of a preferred embodiment of the present invention.
Figure 4:
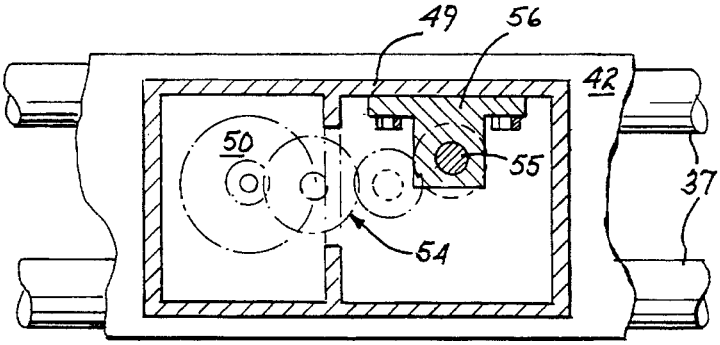
FIG. 4 is a partial top view, partially in section, along the section 4—4 of FIG. 3, of a bottom portion, the powered part, of the vertical adjustment means of a preferred embodiment of the present invention, showing the bottom portion of the telescoping means thereof.

FIG. 1 shows a preferred embodiment of the unitary device 21 for patient gait training of the present invention. The unitary device 21 includes support means 22, underlying which is carriage means 23. Support means 22 includes vertical adjustment means 24 and harness connection means 25. Vertical adjustment means 24 includes telescoping means 26 below an upper portion 27 of vertical adjustment means 24. Carriage means 23 includes a pair of horizontal rail means 28 to which wheel means 29 are connected. Harness connection means 25 includes a horizontally-disposed "Y"-shaped connection means 30 including a foot end 31, having a vertical connection element 31*a*, and a pair of arm ends 32. Harness connection means 25 is adapted to be removably connected to harness means 33 (shown in FIG. 1A), preferably by the fastening means of a pair of D-rings 32*a*, one located at each arm end 32.

Figure 7:
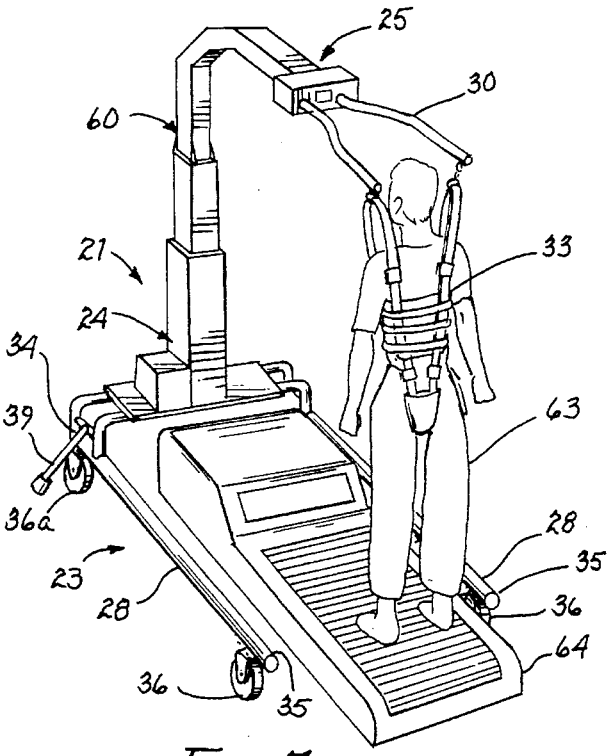
FIG. 7 is a pictorial illustration of a typical treadmill use of a preferred embodiment of the present invention, showing the instant device (with harness means) in use by a patient using a treadmill.
Figure 8:
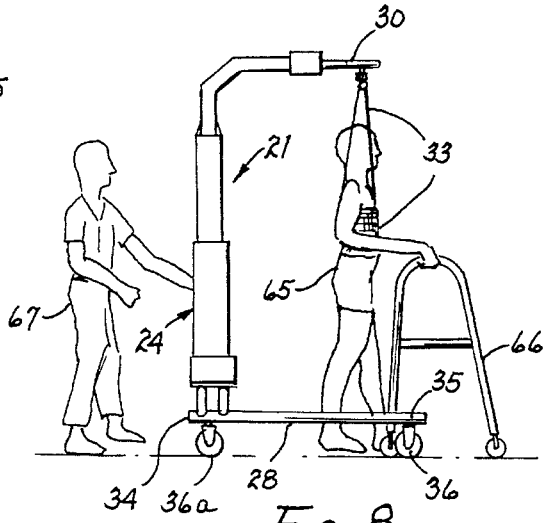
FIG. 8 is a side view of a preferred embodiment of the present invention, showing the instant device in use by a patient using a walker to move over ground, with a therapist controlling the horizontal movement of the device.

Describing the preferred embodiment, as shown best in FIG. 1, in greater detail, the pair of rail means 28 are connected at one end 34, providing a base for support means 22, and the pair of rail means 28 are unconnected at their other end, open end 35. The pair of rail means 28 are of equal length and long enough to provide stable support for the weight of harness means 33 (including a patient) when harness means 33 is connected to (fastening means) D-rings 32*a* (as illustrated in FIG. 7 or FIG. 8) by inserting the respective upper ends of harness loop means 43 into respective D-rings 32*a*. Preferably, for efficient operation of the unitary device 21, wheels 36 at open end 35 may be locked against rolling in well known manners; and wheels 36*a* at the other end 34 of the pair of rail means 28 may be locked in a straight position (in well known manners) in longitudinal line with rail means 28. As part of carriage means 23, parallel beams 37 connect the pair of rail means 28 and underlie support means 22.

As shown in greater detail in FIG. 2, two pivot mechanisms 38 are connected between parallel beams 37, one pivot mechanism 38 above and parallel to each rail means 28. A pivotable bar 39 having a rubber tip 40 is connected perpendicular to each pivot mechanism 38. When this pivotable bar 39 is in place with its rubber tip 40 adjacent the ground or floor and resting on stop 40*a*, as shown in FIG. 2, unitary device 21 is stabilized and less likely to tip by having a wider effective base than provided by the width between the wheel means 29 alone. When not in use, as shown in FIG. 2 in dotted lines, pivotable bar 39 may be locked in slot 41 of support plate 42 attached upon parallel beams 37.

As shown most clearly in FIG. 1A, harness means 33 is constructed so as, with proper therapist use, to hold a patient in an upright position while permitting full leg extension. Harness means 33 includes a pair of vertically-disposed harness loop means 43, multiple horizontally-disposed harness belt means 44, each attached to each harness loop means 33 twice (front and rear) at attachments 45. Each harness belt means 44 is adjustable (in a well-known manner, as shown) at multiple belt adjustments 46 to support a therapist-selected torso portion of a patient. Harness loop means 43 is adjustable (in a well-known manner, as shown best in FIG. 1B) at multiple loop adjustments 47, for any of which may be substituted safety buckles in a well-known way. Harness means 33 includes groin pad means 48, preferably made of a soft and slippery material, attached to the bottoms of harness loop means 43. Using the harness means 33 of the present invention, the therapist may efficiently arrange to support the partial body weight of a patient evenly among groin, abdominal, and chest areas, with legs fully vertically extended, which is highly preferred in performing partial weight bearing gait training. Harness means 33 (attached to a patient, as shown in FIGS. 7–10) may be removably connected to unitary device 21, in a preferred embodiment hereof, by slipping the upper parts of harness loop means 43, respectively, into D-rings 32*a* of harness means 33.

FIGS. 3, 4, 5, and 6 show most clearly the details of the preferred embodiment of the telescoping means 26 of the vertical adjustment means 24 of the present invention. Atop support plate 42, side by side within casing 49, as shown, are motor means 50 and bottom element 51 of telescoping means 26. Note that a battery and a battery recharger are located in the casing 49. Top element 52 of telescoping means 26 is slidably mounted within the casing 49 of bottom element 51 and supported therein by bearings 53. Motor means 50, through gearing arrangement 54, is connected (in well known manner) for turning threaded shaft 55 in a selected direction. Threaded shaft 55 is vertically supported (at an unthreaded portion of shaft 55) by bearing support 56, which is bolted to casing 49 of bottom element 51, as shown most clearly in FIG. 4. As most clearly shown by FIG. 5, threaded nut 57, through which threaded shaft 55 passes and to which threaded shaft 55 is threadedly connected, is bolted to top element 52 of telescoping means 26, in such (well-known) manner that rotation of threaded shaft 55 in one direction raises top element 52, and rotation of threaded shaft in the other direction lowers top element 52. Thus, motor means 50 may be used, in well known manner, for controlling the vertical adjustment, the height, of top element 52 of telescoping means 26 of vertical adjustment means 24. As most clearly shown by FIG. 6, for stability, top bearing support 58, firmly attached to top element 52, rotatably supports the unthreaded upper end 59 of threaded shaft 55.

FIGS. 1 and 3 most clearly illustrate the attachment of harness connection means 25 to top element 52 at junction 60. Vertical connection element 31a is preferably mounted rotatably at junction 60 in top element 52 of telescoping means 26, so as to obtain rotation (in any well-known manner) in the horizontal plane of "Y"-shaped connection means 30 about the axis of vertical adjustment means 24. Such rotatable mounting permits the lifting of a patient to the side of, for example, a treadmill, and then the movement of that patient to a position over the treadmill. Horizontally-disposed "Y"-shaped connection means 30 of harness connection means 25 is thus vertically controlled by vertical adjustment means 24. Strain gages 61 may be mounted on arm ends 32 for giving information about the weight supported at arm ends 32 to instrumentation 62, available to the therapist controlling vertical adjustment means 24.

FIGS. 7, 8, 9, and 10 most clearly illustrate some primary manners of use of the preferred embodiment of the present invention. FIG. 7 shows the unitary device 21 of the present invention, with a patient 63 in harness means 33, attached as part of unitary device 21. The patient 63 is shown on treadmill 64, located between the pair of horizontal rail means 28 of the carriage means 23 of the present invention. As shown in detail in FIG. 1A, the various adjustments available for harness means 33 are used by the therapist to ensure that harness means 33 supports the partial body weight of patient 63 evenly among groin, abdominal, and chest areas when harness means 33 is connected to and raised (under therapist control) by "Y"-shaped connection means 30, as illustrated in FIG. 7. Preferably, when unitary device 21 is used by a patient 63 with a treadmill 64, wheels 36 at open end 35 are locked against rolling, and wheels 37 at the other end 34 of the pair of rail means 28 are locked in a straight position in longitudinal line with rail means 28. Also, it is preferred that pivotable bars 39 be in place adjacent the ground whenever unitary device 21 is in stationary use for stabilization purposes.

FIG. 8 shows the unitary device 21 of the present invention in use by a patient 65 using a walker 66 to move over ground, with a therapist 67 controlling the horizontal movement of the unitary device 21. Again, as shown in detail in FIG. 1A, the various adjustments available for harness means 33 are used by the therapist 67 to ensure that harness means 33 supports the partial body weight of patient 65 evenly among groin, abdominal, and chest areas when harness means 33 is connected to and raised (under control of therapist 67 by operating any well-known up-down control means, not shown, to raise or lower vertical adjustment means 24) by "Y"-shaped connection means 30, as illustrated in FIG. 8. As shown, therapist 67 may push unitary device 21 at about the same speed as patient 65 is walking using walker 66; and therapist 67 is permitted unobstructed access to both legs of patient 65 so that therapist 67 may assist with the legs of patient 65 during PWB gait training. The construction of unitary device 21, especially the low and out-of-the-way positions of horizontal rail means 28, enables such important unobstructed access to both legs. Preferably, when unitary device 21 is used by a patient 65 with a walker 66, wheels 36 at open end 35 are not locked against rolling, and wheels 37 at the other end 34 of the pair of rail means 28 may or may not be locked in a straight position in longitudinal line with rail means 28, depending on the therapists wishes and the path of the walker patient 65.

Figure 9:
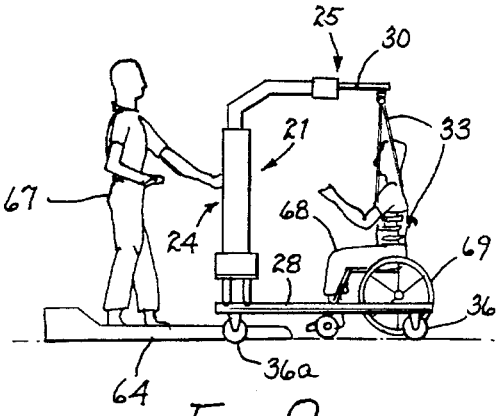
FIG. 9 is a side view of a preferred embodiment of the present invention, showing the instant device in use by a wheelchair patient to help lift the patient out of the wheelchair, with a therapist controlling both the vertical adjustment means and the horizontal movement of the device.
Figure 10:
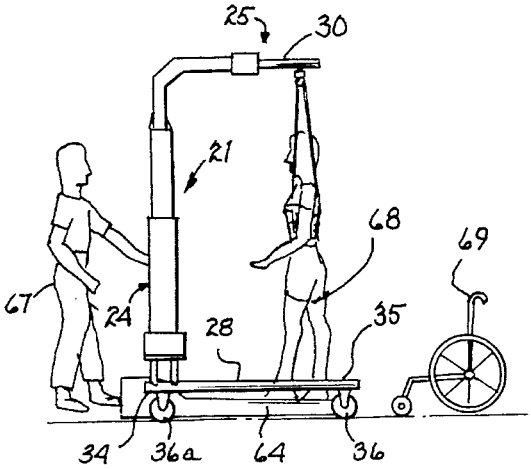
FIG. 10 is a side view of a preferred embodiment of the present invention, showing the instant device in use by a wheelchair patient using a treadmill, with a therapist controlling the device and monitoring the gait training.

FIG. 9 shows the instant unitary device 21 in use by a wheelchair patient 68 to help lift the patient 68 out of the wheelchair 69, with a therapist 67 controlling both the vertical adjustment means 24 and the horizontal movement of unitary device 21. Again, as shown in detail in FIG. 1A, the various adjustments available for harness means 33 are used by the therapist 67 to ensure that harness means 33 supports the partial body weight of patient 68 evenly among groin, abdominal, and chest areas when harness means 33 is connected to and raised by "Y"-shaped connection means 30, as illustrated in FIG. 9. As illustrated by FIG. 9, to prepare wheelchair patient 68 for PWB gait training on treadmill 64, therapist 67 has moved unitary device 21 into position over wheelchair 69 and in line with treadmill 64. Wheels 36 are then preferably locked against rolling and harness means 33 (and patient 68) is raised vertically until patient 68 is in a vertical PWB position, and the wheelchair 69 may optionally be moved out of the way. Then wheels 36 are unlocked so that rolling may occur (wheels 36a may be optionally locked to roll only longitudinally), and unitary device 21 and patient 68 are moved by the therapist into a position over treadmill 64, as shown in FIG. 10. Again, during PWB gait training of patient 68 on treadmill 64, preferably wheels 36 at open end 35 are locked against rolling, and wheels 37 at the other end 34 of the pair of rail means 28 are locked in a straight position in longitudinal line with rail means 28. Also, it is preferred that pivotable bars 39 (as shown in FIG. 7) be in place adjacent the ground whenever unitary device 21 is in stationary use for stabilization purposes.

With reference to FIG. 10, it is noted that therapist 67 has unobstructed access to both legs of patient 68 during treadmill gait training. When gait training of wheelchair patient 68 is completed, unitary device 21 may once more be moved forward over wheelchair 69, and patient 68 lowered into position, and harness means 33 removed.

FIG. 1 best illustrates how the preferred placements of the various elements of unitary device 21 combine to provide a unitary solution to the problems of the prior art.

It is especially pointed out that the telescoping features of vertical adjustment means 24 combined with the "Y"-shaped connection means 30 of harness connection means 25 maintain an efficient and safe harness system while providing a low profile unitary device 21, enhancing the transportability of unitary device 21 and enabling movement through low doorways and in rooms with low ceilings, even with tall adult patients. And the ease of movement of unitary device 21 enhances its usefulness, horizontally and vertically, in assisting wheelchair patients and others similarly impaired into a gait training position, even from the side of the unitary device 21 using the preferred rotatable connection between the vertical adjustment means 24 and the harness connection means 25. It is further pointed out that the construction of harness means 33 as used in unitary device 21 permits the therapist to achieve the proper upright posture and leg extension for patients doing PWB gait training. And it is further pointed out that the construction and mobility of the unitary device of the present invention makes it especially useful in PWB gait training with walkers and other attachments. And it is pointed out that the construction of the unitary device of the present invention provides the recommended fully vertical lift for partial weight bearing. It also provides, as mentioned, the recommended constant easy access for the therapist to both legs of the patient during training.

Further advantages of applicant's invention will be apparent to those skilled in the art from the above descriptions and the below claims.

What is claimed is:

1. In a unitary device for use in partial weight bearing gait training of a patient, a. harness means completely surrounding an upper body portion of the patient and holding the patient in a vertically upright position for permitting the patient to walk while being supported by said harness means;

b. support means coupled to said harness means for controlled vertical support of said harness means; and c. underlying and coupled to said support means, carriage means for controlled horizontal movement of said unitary device by a therapist;

said support means being coupled to a distal end of said carriage means and extending upward and bending toward an opposite end of said carriage means for permitting the therapist unobstructed access to both legs of the patient being supported by said unitary device in proximity to said opposite end of said carriage means;

said carriage means comprising a pair of horizontal parallel rail means unconnected at a first end of said pair of rail means;

said support means being mounted adjacent a second end of said pair of rail means;

said support means comprising:

a. harness connection means for connecting said support means to said harness means; and b. vertical adjustment means, including a fixed upper portion of said vertical adjustment means parallel with said pair of rail means, for controlling the height of said harness connection means; and said harness connection means comprising:

a. horizontally-disposed "Y"-shaped connection means for holding said harness means above both shoulders of the patent and including a foot end and a pair of arm ends;

b. said foot end of said "Y"-shaped connection means is rigidly and fixedly attached to said upper portion of said vertical adjustment means; and c. said arm ends of said "Y"-shaped connection means are each removably connected to said harness means.

2. The unitary device of claim 1 wherein said harness means is coupled to a portion of said support means that is angled toward said opposite end of said carriage means and is located above said first end of said pair of rail means.

3. The unitary device of claim 2 wherein wheel means are connected to said pair of rail means for permitting the therapist to move said device horizontally.

4. The unitary device of claim 3 wherein said device includes motor means for implementing controlled incremental vertical movement of said harness means.

5. The unitary device of claim 1 wherein said arm ends of said "Y"-shaped connection means include strain gage means for generating information readable by the therapist.

6. The unitary device of claim 1 wherein said arm ends of said "Y"-shaped connection means include fastening means for removably attaching said harness means to said arm ends of said "Y"-shaped connection means.

7. The unitary device of claim 1 wherein said vertical adjustment means comprises telescoping means for controlling the height of said upper portion of said vertical adjustment means.

8. The unitary device of claim 7 including battery means coupled to motor means for operating said motor means for controlling the height of said upper portion of said vertical adjustment means.

9. The unitary device of claim 1 wherein said harness connection means is rotatable about said vertical adjustment means.

10. The unitary device of claim 1 wherein said harness means includes a pair of vertically-disposed harness loop means, multiple horizontally-disposed harness belt means attached to said harness loop means, and each said harness belt means being adjustable to support a selected torso portion of said patient for supporting the partial body weight of said patient as desired among groin, abdominal, and chest areas.

11. The unitary device of claim 1 wherein said pair of rail means are sized and configured to accommodate a treadmill substantially between and below said rail means.

12. In a unitary device for use in partial weight bearing gait training of a patient, a. harness means completely surrounding an upper body portion of the patient and holding the patient in an upright vertical position for permitting the patient to walk while being supported by said harness means;

b. support means coupled to said harness means for controlled vertical support of said harness means;

c. said support means comprises harness connection means for connecting said support means to said harness means and vertical adjustment means, for controlling the height of said harness connection means said vertical adjustment means includes a fixed upper portion parallel to the ground and rigidly and fixedly connected to a base portion of said harness connection means which comprises a "Y"-shaped member, within the same plane containing said upper portion, having two end portions coupled to said harness means and adapted to be above both shoulders of the patient while in an upright position.

13. The unitary device of claim 12 wherein said support means is configured to accommodate a treadmill located below said harness means.

* * * * *